US007069889B2

(12) United States Patent
Lechner et al.

(10) Patent No.: US 7,069,889 B2
(45) Date of Patent: Jul. 4, 2006

(54) CAMSHAFT, ESPECIALLY FOR AN INTERNAL COMBUSTION ENGINE OF A MOTOR VEHICLE, COMPRISING SHIFTABLE CAMS

(75) Inventors: Martin Lechner, Stuttgart (DE); Falk Schneider, Münchingen (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 10/536,277

(22) PCT Filed: May 26, 2004

(86) PCT No.: PCT/DE2004/001098

§ 371 (c)(1),
(2), (4) Date: May 24, 2005

(87) PCT Pub. No.: WO2004/109068

PCT Pub. Date: Dec. 16, 2004

(65) Prior Publication Data

US 2006/0011161 A1 Jan. 19, 2006

(30) Foreign Application Priority Data

Jun. 2, 2003 (DE) ..... 103 25 042

(51) Int. Cl.
*F01L 1/02* (2006.01)

(52) U.S. Cl. ..... 123/90.27; 123/90.16; 29/888.1

(58) Field of Classification Search ..... 123/90.27, 123/90.31, 90.33, 90.34, 90.15, 90.16, 90.17, 123/90.18; 29/888.1; 74/567
See application file for complete search history.

(56) References Cited

U.S. PATENT DOCUMENTS

| | | | | |
|---|---|---|---|---|
| 4,886,022 A | | 12/1989 | Nakai | |
| 5,404,770 A | * | 4/1995 | Kruger | 74/568 R |
| 5,746,166 A | | 5/1998 | Valasopoulos | |
| 6,615,468 B1 | * | 9/2003 | Bloecker et al. | 29/281.1 |

FOREIGN PATENT DOCUMENTS

| | | |
|---|---|---|
| DE | 42 22 477 A | 2/1993 |
| DE | 100 30 904 A | 1/2002 |
| WO | WO 94/15075 A | 7/1994 |
| WO | WO 2004/001199 A2 | 6/2003 |

* cited by examiner

*Primary Examiner*—Thomas Denion
*Assistant Examiner*—Ching Chang
(74) *Attorney, Agent, or Firm*—Collard & Roe, P.C.

(57) ABSTRACT

Disclosed is a camshaft, especially for an internal combustion engine of a motor vehicle, comprising at least one cam that is provided with cam segments (2, 3), which can be displaced relative to each other. The aim of invention is to create a compact camshaft structure while obtaining or ensuring good and stable guidance between the cam segments (2, 3) that can be displaced relative to each other. Said aim is achieved by placing the ends of the U-legs of the second cam segment (3), which has the shape of a horseshoe and is movable while the other cam segment (2) is connected in a fixed manner to the camshaft, entirely within the outer contour of the basic camshaft material located between the U-legs in the radially deployed position of the second cam segment (3), said U-legs resulting from the horseshoe shape of said cam segment (3) and extending in a free manner at the ends thereof.

3 Claims, 9 Drawing Sheets

Figure 1A:
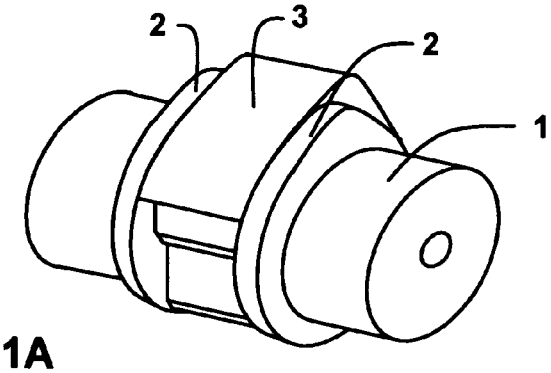

FIG. 2A
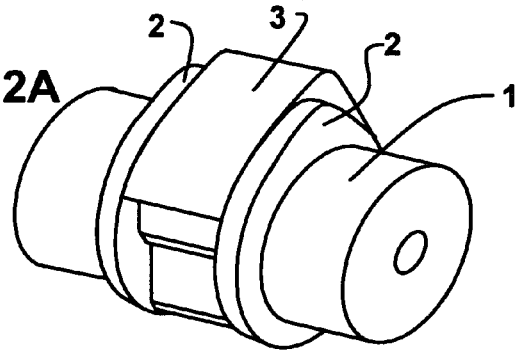
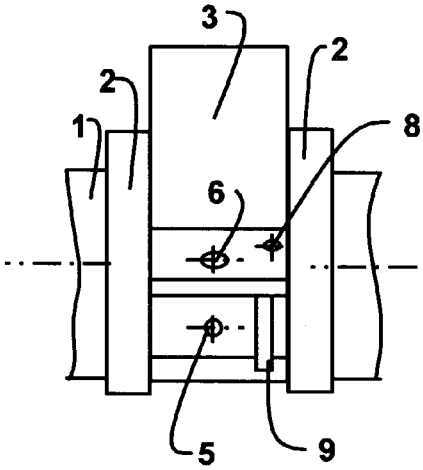
FIG. 2B
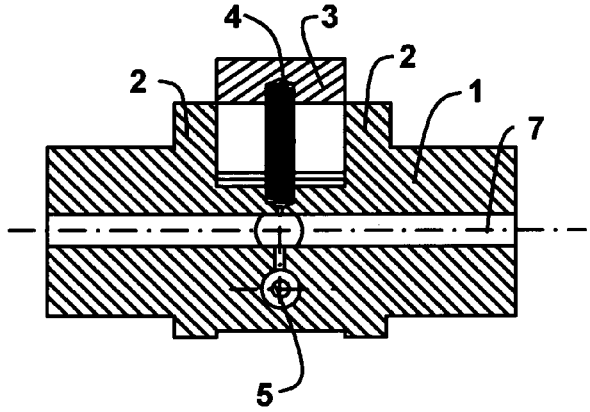
FIG. 2C
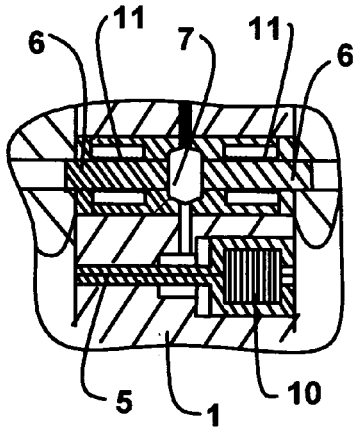
FIG. 2D
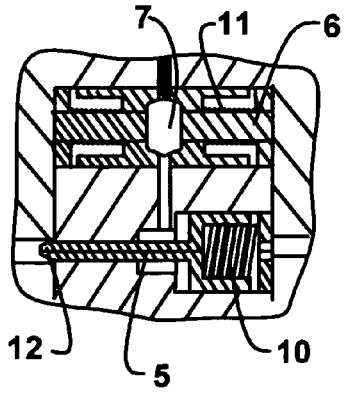
FIG. 2E

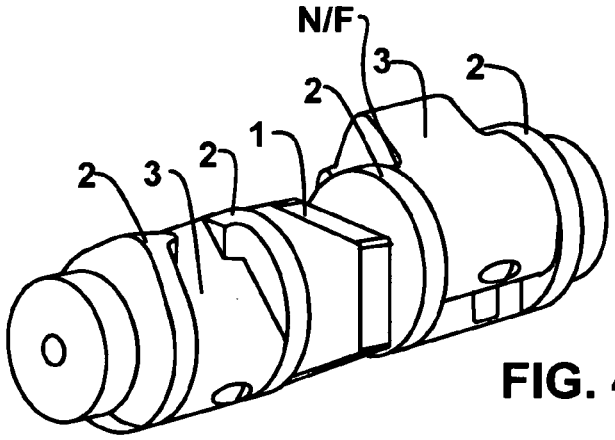
FIG. 4A
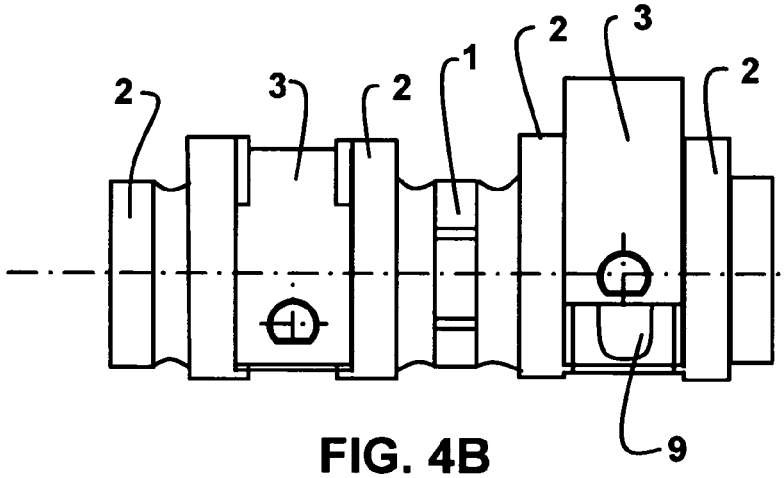
FIG. 4B
FIG. 4C
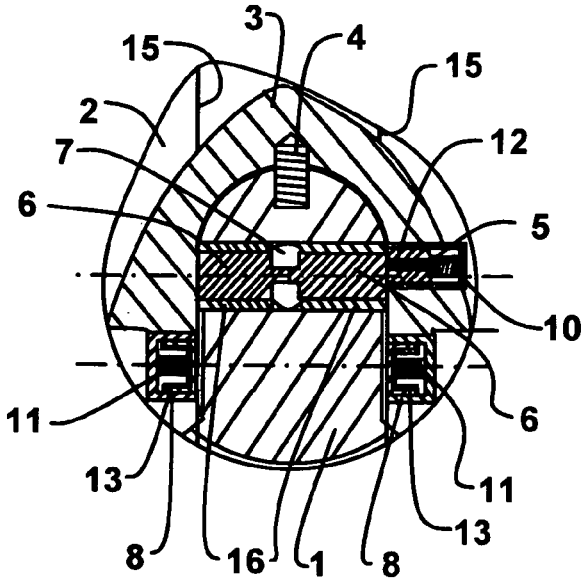
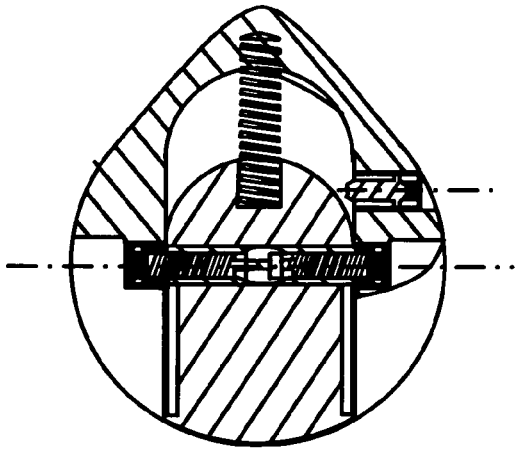
FIG. 4D

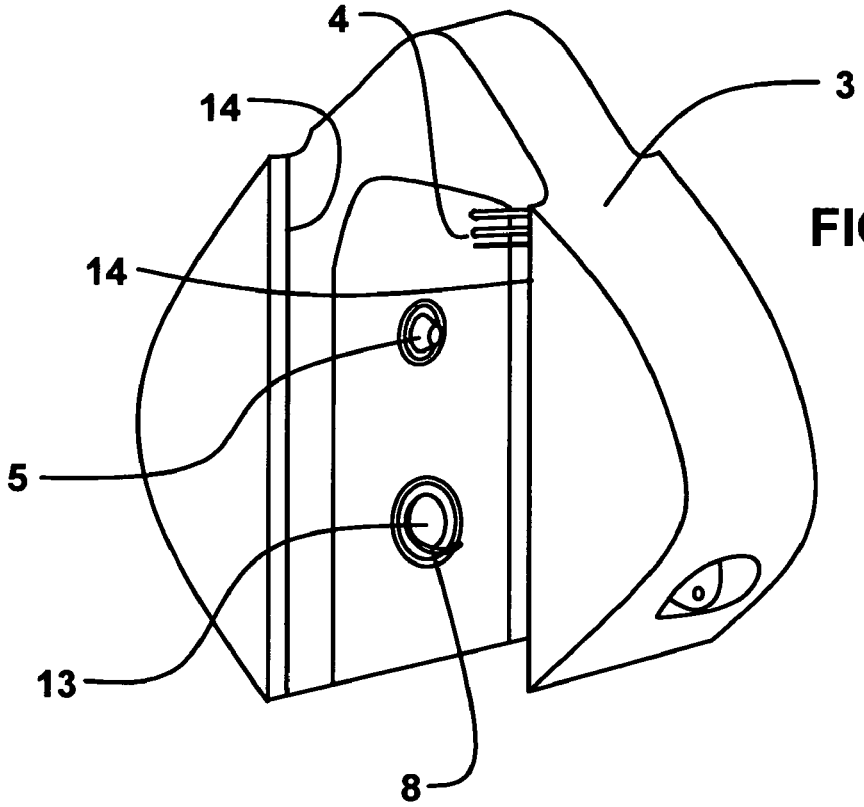
FIG. 5A
FIG. 5B
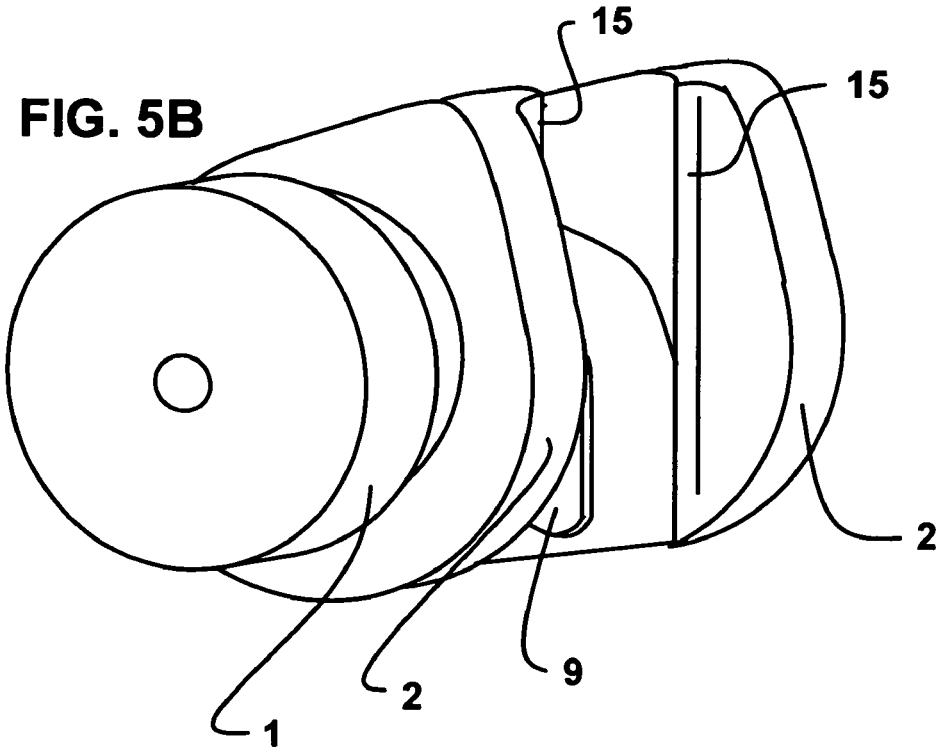

FIG. 8A
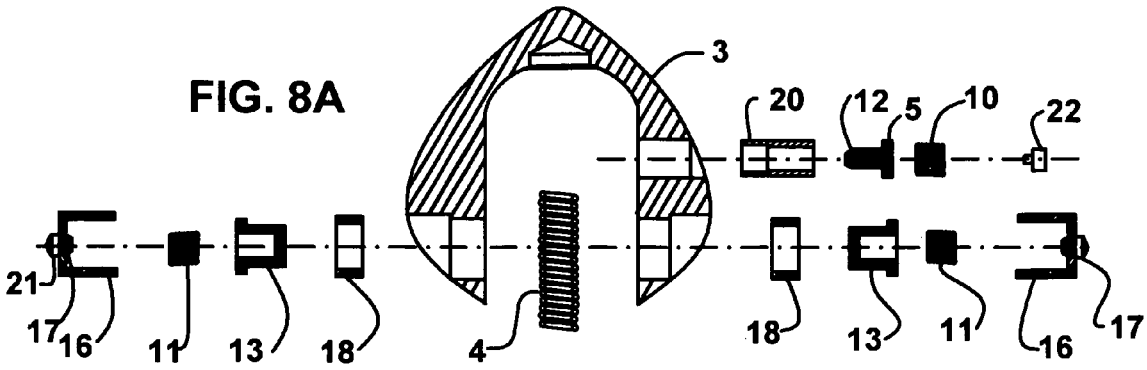
FIG. 8B
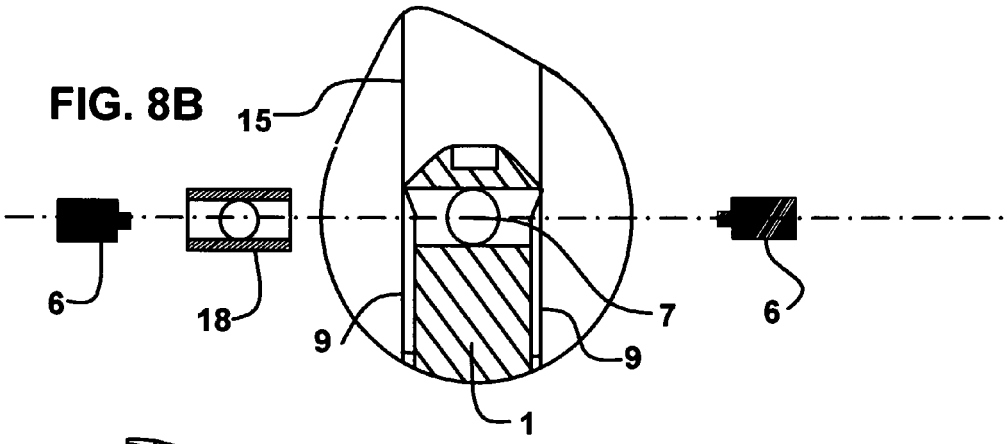
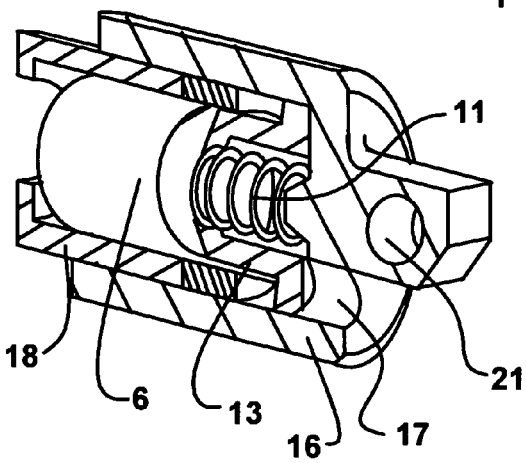
FIG. 8C
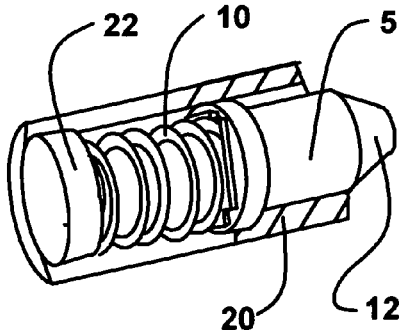
FIG. 8D

CAMSHAFT, ESPECIALLY FOR AN INTERNAL COMBUSTION ENGINE OF A MOTOR VEHICLE, COMPRISING SHIFTABLE CAMS

CROSS REFERENCE TO RELATED APPLICATIONS

Applicants claim priority under 35 U.S.C. §119 of German Application No. 103 25 042.5 filed on Jun. 2, 2003. Applicants also claim priority under 35 U.S.C. §365 of PCT/DE2004/001098 filed on May 26, 2004. The international application under PCT article 21(2) was not published in English.

This invention relates to a camshaft, in particular of an internal combustion engine of a motor vehicle, comprising displaceable cam segments of at least one cam according to the said camshaft.

Such a camshaft is the object of WO 2004/001199A2 which was not prepublished with respect to the priority of the patent application. With larger radial adjustment paths of the cam segments with respect to one another and/or the second movable cam segment with respect to the first cam segment, which is stationary on the camshaft, a relatively great camshaft base body area between the legs of the second camshaft is necessary for its guidance for strength reasons. The radial adjustment path there is therefore limited with a compact camshaft design.

U.S. Pat. No. 4,886,022 discloses a camshaft with which all the other features forming the generic type are already implemented, with the exception of the last component feature of the preamble of claim 1.

This invention relates primarily to the problem of creating an improvement in the camshaft according to WO 2004/001199 A2.

This problem is solved with a generic camshaft by an embodiment according to the characterizing features the said camshaft.

Advantageous and expedient embodiments of this approach are the object of the subclaims.

This invention is based on the general idea of having the second cam segment, which is designed in a horseshoe shape, running freely radially on the free U-shaped legs. This makes it possible for the second cam segment to be guided radially on the camshaft base body, which is situated between the U-shaped legs and/or in a tongue-and-groove guidance between the first and second cam segments. End stops ensure a maximum displacement path of the first cam segment directed radially inward and outward.

For a temporary fixation of the second movable cam segment with respect to the first cam segment, locking elements that are explained in greater detail below and are preferably hydraulically operated are used.

Advantageous exemplary embodiments are depicted in the drawing and are explained in greater detail below, with respect to the individual drawings in each case.

FIG. 1: shows various sections and embodiments of a cam of a camshaft of an internal combustion engine in a motor vehicle having mutually adjustable cam segments.

FIG. 1A shows an axial detail of a camshaft having a camshaft base body 1 and a cam with mutually adjustable cam segments, namely a first cam segment 2, which is immovable with respect to the camshaft base body 1, and a shiftable, radially displaceable, second cam segment 3.

Figure 1C:
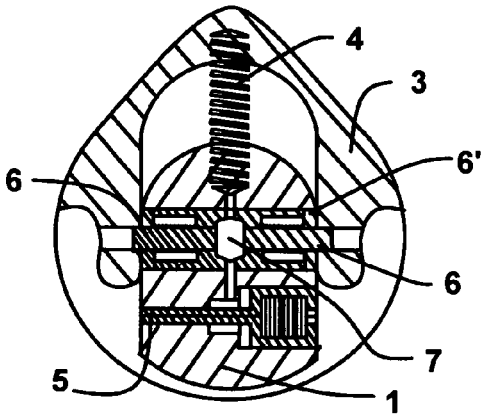
Figure 1B:
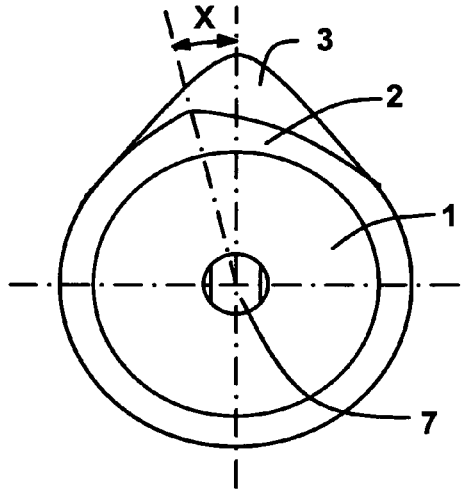
Figure 1D:
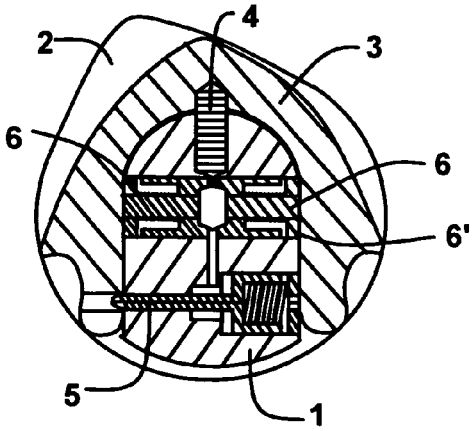

The two cam segments 2 and 3 may be phase-shifted with respect to one another by a rotational measure X (FIG. 1B). An oil supply channel 7 is provided inside the base body 1 of the camshaft.

The second cam segment 3 may assume a position (FIG. 1C and FIG. 1E) in which it is deployed radially with respect to the base body 1 of the camshaft or a position (FIG. 1D) in which it is inserted in the opposite direction. The second cam segment can be locked in both of the aforementioned positions, each of which is shiftable. The locking elements 5 and 6 are provided to achieve this lockability, each locking element being mounted on the base body 1 of the camshaft and able to engage in abutments on the second cam segment 3. In the simplest case, the abutments are boreholes in the second cam segment 3. The locking means 5, 6 can be shifted through pressure changes in the oil supply in the oil supply channel 7.

The locking elements 5 and 6 are each spring-loaded pistons. For good guidance of the pistons 6, which is easy to achieve, they may cooperate with the guide rings 6'.

Figure 1E:
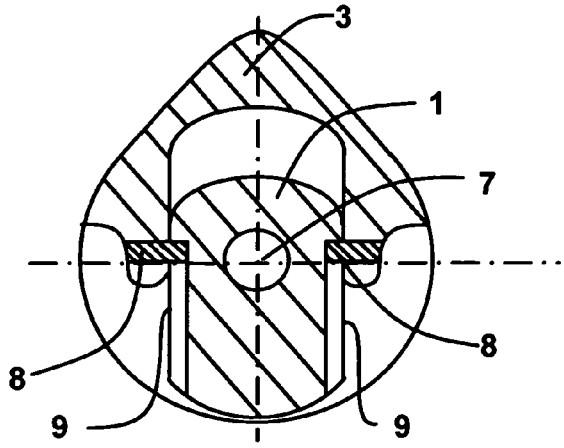
Figure 3A:
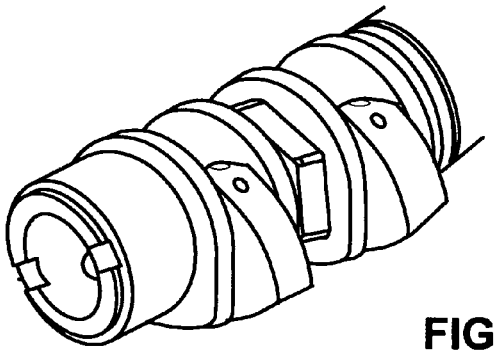
Figure 3B:
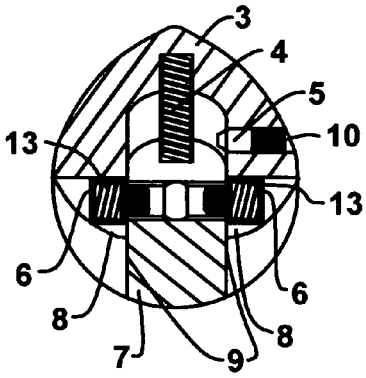
Figure 3C:
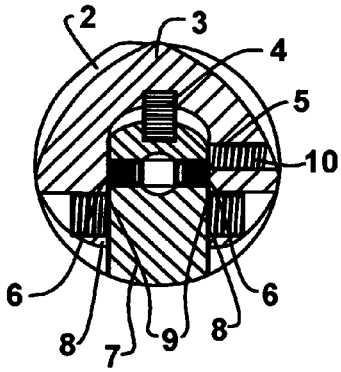
Figure 3D:
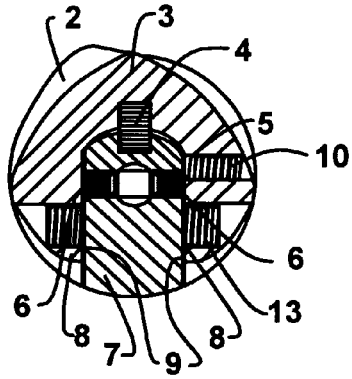

FIG. 1B and FIG. 1C run axially centrally through the base body 1 of the camshaft between two first cam segments 2 that are arranged side by side with a distance between them. However, the FIG. 1E is outside of the aforementioned central section. Therefore, lateral grooves 9 running radially are discernible in this FIG. 1E within the base body of the camshaft 1. Due to the pin-shaped stops 8 inserted into the second cam segment, a deployment limit is created for the second cam segment with respect to the first cam segment.

FIG. 2: shows principle views FIGS. 2A, 2B, 2C, 2D and 2E of a variant of the camshaft according to FIG. 1.

In the FIG. 2B, it can be seen in a view of a cam how a radially displaceable second cam segment 3 is shiftable between two adjacent first cam segments 2. In the retracted position of the second cam segment 3, the joint cam profile of the first cam segment is operatively active. In the deployed position of the second cam segment 3, only the base circle of the first cam segment 2 is operatively active while the "tip" area of the cam is formed by the deployed second cam section 3.

The groove 9 with the stop 8 assigned to it is clearly discernible in the FIG. 2B. The position of the locking elements 5 and 6 also shows this view quite clearly.

The locking elements 5, 6 in FIG. 2 correspond to those in FIG. 1 and are shown here on a larger scale merely as details. In this enlarged diagram, the springs 10, 11 of this locking element 5, 6 can also be discerned clearly.

FIG. 3: shows an embodiment shown in partial FIGS. 3A, 3B, 3C through FIG. 3D in which in principle the same locking elements are used as in the embodiments described above but they are positioned differently. As in the embodiment according to FIG. 1, a spring 4 is provided in each case to displace the second cam segment 3 into its deployed position in the unlocked state.

FIG. 4: shows another alternative embodiment in FIGS. 4A, 4B, 4C and 4D of the camshaft according to FIG. 1.

The essential difference in this version in comparison with the previous versions consists of an expanded guidance of the second cam segment 3 with respect to the base body 1 of the camshaft and/or the laterally adjacent first cam segments 2.

This enlarged guidance consists of providing a type of tongue-and-groove guidance N/F between the first cam segments 2 and the second cam segment 3 which is displaceably guided between these two. The abutments for the second cam segment 3 for the segment to stop against the end stops of a groove 9 provided in the camshaft base body 1 are formed here by parts of the locking elements 5 and 6. One of these stop elements is assigned reference number 8. A bearing sleeve 16 which is also inserted into the camshaft base body 1 serves as a stop for the second cam segment 3 with respect to the groove 9. The locking pin 5 is designed as a conical pin 12 in its forward anterior region. This simplifies engagement of the lock. In the partial view in FIG. 4C, there is a restoring element 13 for locking the second cam segment 3 in this deployed out position.

The tongue-and-groove guide between a first and a second cam segment 2, 3 is indicated with guide faces 15 depicted in the view of FIG. 4C.

FIG. 5: shows in FIGS. 5A and 5B an exploded diagram of a first cam segment and two second cam segments.

This diagram shows clearly how the tongue-and-groove guide N/F is designed between the two cam segments 2, 3. Guide paths 14 on the second cam segment 3 are assigned to the guide faces 15 of the tongue-and-groove guidance on the first cam segment 2. All the other reference numbers denote parts and features that have already been described.

FIG. 6: shows various sections of a large diagram of the locking elements assigned to a second cam.

Essentially these locking elements 5 and 6 are designed like those in the exemplary embodiments already described above.

Figure 6A:
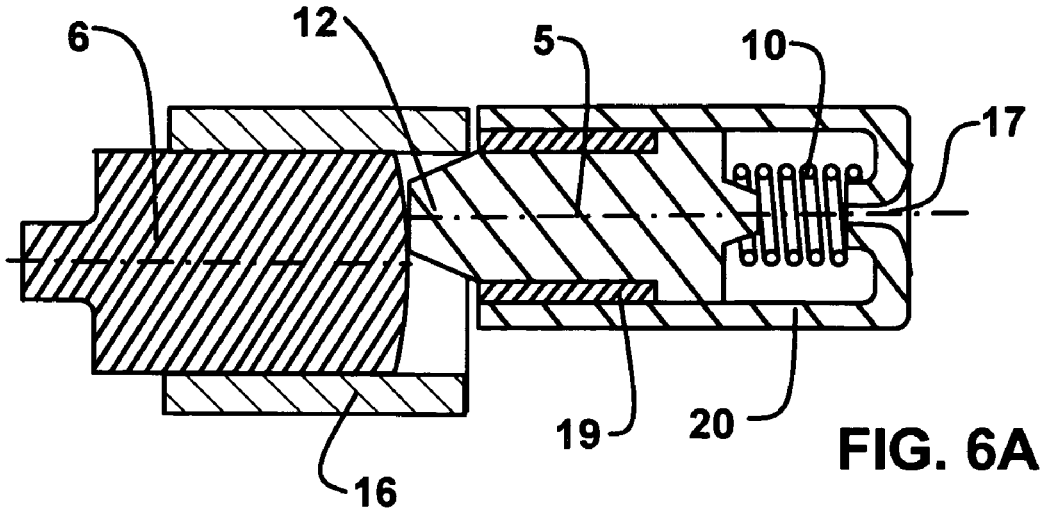
Figure 6B:
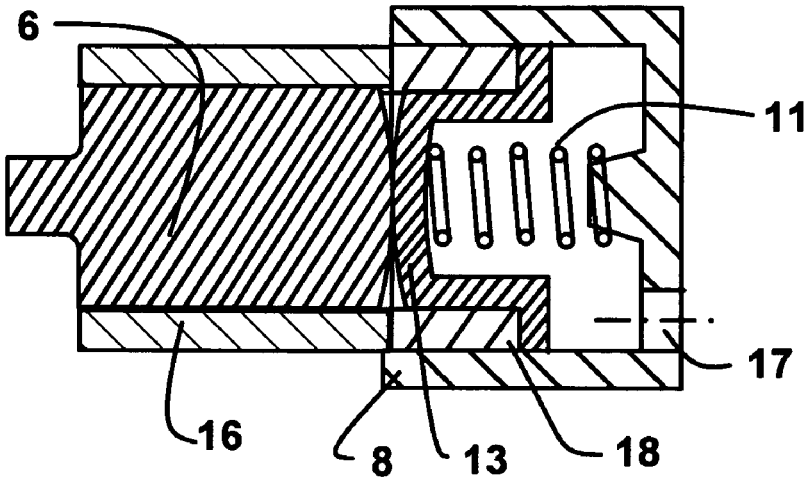
Figure 6C:
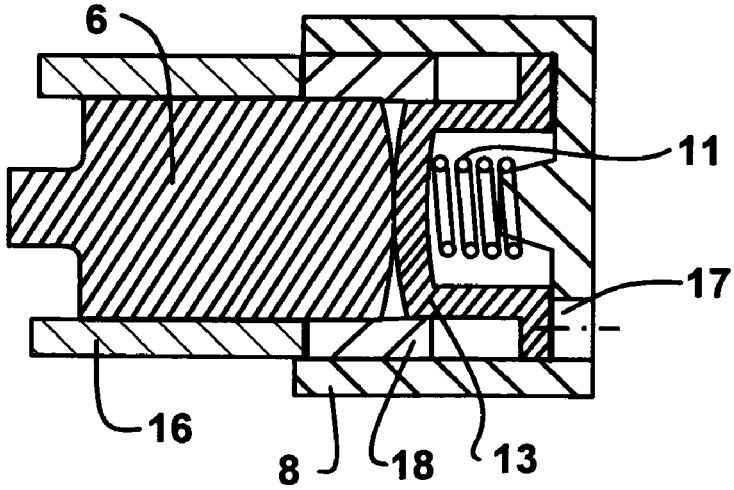
Figure 7A:
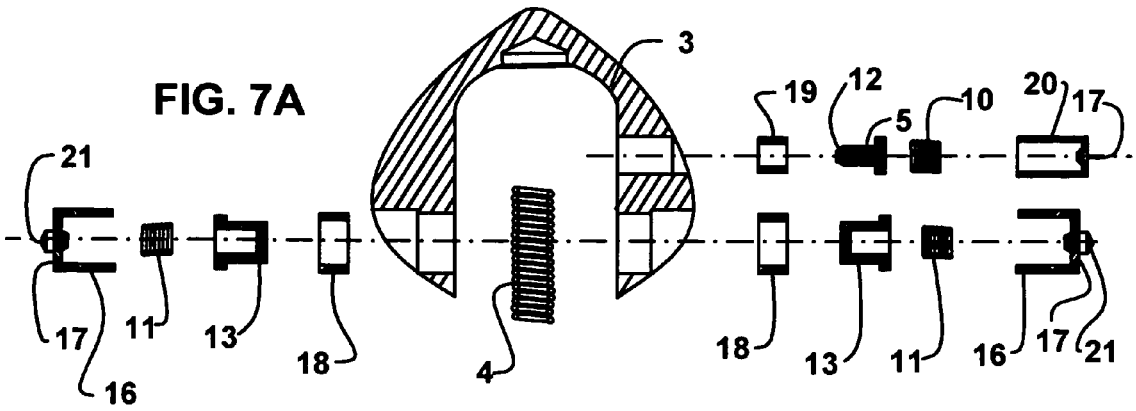
Figure 7B:
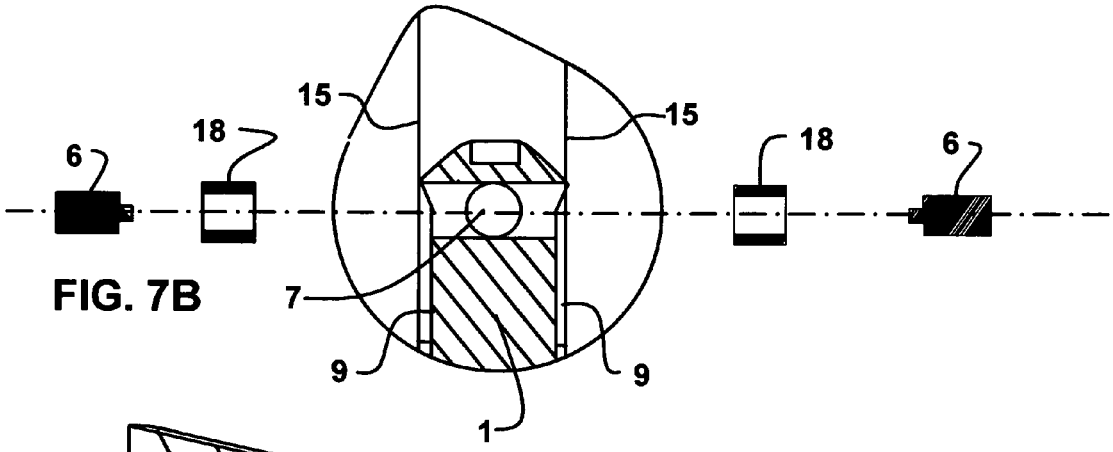
Figure 7C:
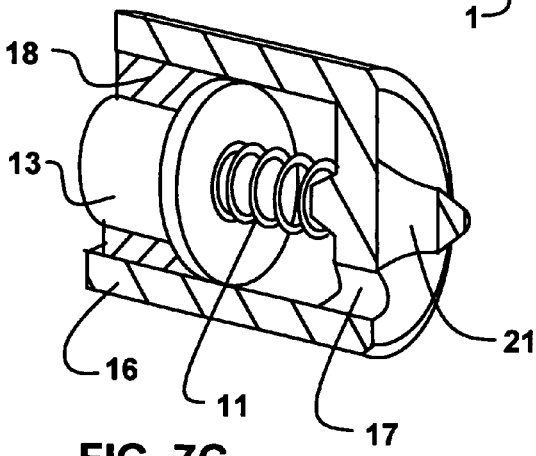
Figure 7D:
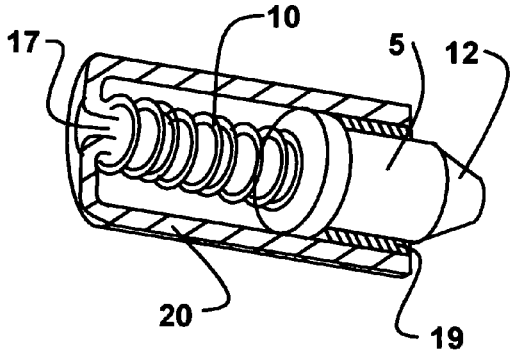

A guide sleeve 19 in the partial view of FIGS. 6A and 6B has not yet been mentioned. The same thing also applies with respect to a vent opening 17 in the locking element 5. The views in FIGS. 6A and 6C each show how the respective locking elements 5, 6 engage. The single locking part 5 is mounted together with its components assigned to the second cam segment 3 in a pot-shaped sleeve 20.

FIG. 7: shows an exploded diagram in FIGS. 7A, 7B, 7C and 7D of the locking device according to FIG. 6, for example, in particular.

The borehole 21, which is shown there on the stop sleeve 16 and serves as an assembly and positioning aid, has not been mentioned previously.

FIG. 8: shows an exploded diagram in FIGS. 8A, 8B, 8C and 8D of the locking element 6 already described above.

Figure 9A:
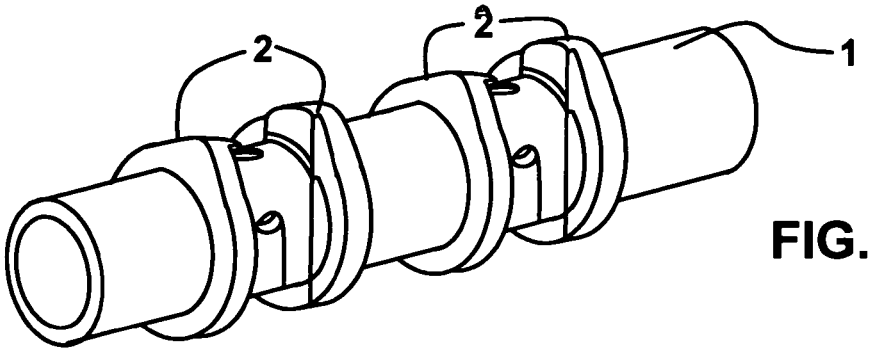
Figure 9B:
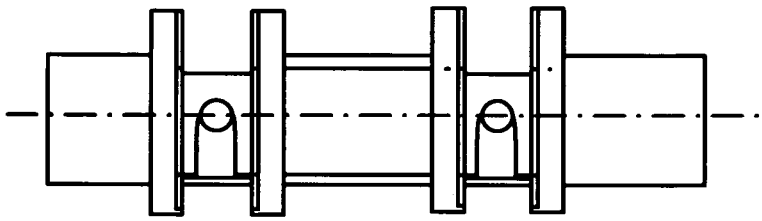
Figure 9C:
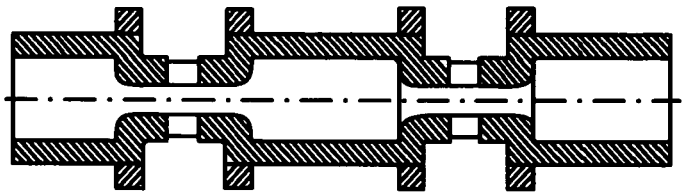
Figure 9D:
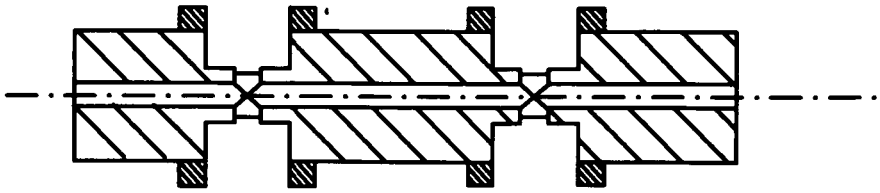
Figure 9E:
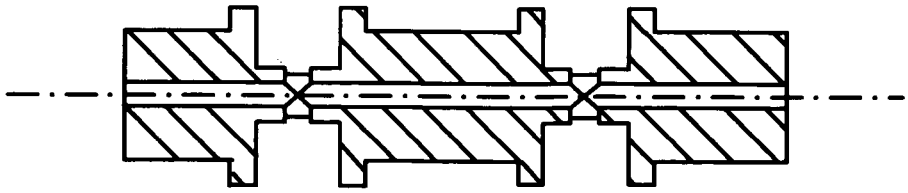

FIG. 9: shows exemplary embodiments of camshaft base bodies having first cam segments, namely FIG. 9A: an assembled camshaft with an inner tubular element produced by IHU (interior high-pressure-forming method) and the joined first cam segment 2, FIG. 9B: a side view of the camshaft according to A, FIG. 9C: section through the camshaft according to A, FIG. 9D: sectional diagram of a machined camshaft base body produced, e.g., by casting, forging or reworking the whole with the joined first cam 2, FIG. 9E: a sectional diagram of a camshaft which may be, for example, a blank part produced by casting or by forging or machining from the whole.

The invention claimed is:

1. A camshaft of an internal combustion engine of a motor vehicle in which at least one cam comprises cam segments that are mutually adjustable in a controlled manner radially to the camshaft axis, namely a first and a second cam segment (2, 3), the two cam segments (2, 3) have functional, shiftable cam profile regions that are separately activatable, the first cam segment (2) is designed as a component of a base body (1) which is immovable with respect to a rotatable base body (1) of the camshaft, the second cam segment (3) is designed to be adjustable with respect to the first cam segment (1), the second cam segment (3) encloses the camshaft base body (1) it in a horseshoe shape and is mounted to be radially displaceable with respect to the camshaft axis, the second cam segment (3) is temporarily lockable in at least two positions which are different distances apart from the camshaft axis radially by means of shiftable attachment means (6, 5), namely in a first and a second deployment position, wherein the second cam segment (3) in its radially deployed position with the ends of its U-shaped legs (resulting from its horseshoe shape) being adjacent completely to areas of the outside contour of the camshaft base body situated between the U legs, whereby the U legs end extend freely at their ends.

2. The camshaft according to claim 1, wherein a tongue-and-groove guide (14, 15) for establishing a guidance between these segments is provided between the cam segments (2, 3).

3. The camshaft according to claim 1, wherein the radial displacement path of the second cam segment (3) is limited by stops in the camshaft base body material and/or the first cam (2).

* * * * *